US005469926A

United States Patent [19]

Lessard

[11] Patent Number: 5,469,926

[45] Date of Patent: Nov. 28, 1995

[54] DIRECTIONAL BORING DRILL BIT BLADE

[75] Inventor: Willie J. Lessard, Forest Lake, Minn.

[73] Assignee: bor-mor, Inc., Lino Lakes, Minn.

[21] Appl. No.: 231,237

[22] Filed: Apr. 22, 1994

[51] Int. Cl.[6] ..... E21B 10/60

[52] U.S. Cl. ..... 175/424

[58] Field of Search ..... 175/65, 67, 339, 175/340, 393, 429, 424

[56] References Cited

U.S. PATENT DOCUMENTS 3,389,759 6/1968 Mori et al. ..... 175/424 X 3,838,742 10/1974 Juvkam-Wold ..... 175/424 X 4,534,427 8/1985 Wang et al. ..... 175/67

4,674,579 6/1987 Geller et al. ..... 175/424 X

*Primary Examiner*—Michael P. Buiz

*Attorney, Agent, or Firm*—Leone & Moffa

[57] ABSTRACT

A directional earth boring drill bit blade includes an earth boring drill bit blade body having a cutting edge and having at least one fluid conduit through said earth boring drill bit blade body. A fluid nozzle is affixed to said at least one fluid conduit at the cutting edge. The earth boring drill bit blade body is adapted to be mounted to a boring tool body. The at least one conduit and nozzle cooperate to channel fluid so as to cool the directional boring drill bit blade and control steering while boring.

17 Claims, 5 Drawing Sheets

DIRECTIONAL BORING DRILL BIT BLADE

FIELD OF THE INVENTION

This invention relates to directional boring machines for substantially horizontal, trenchless earth boring and, more particularly, to an earth boring directional boring drill bit blade having fluid conduits and high pressure spray nozzles located within the boring drill bit blade where a fluid spray is used for cooling and steering a drill string.

BACKGROUND OF THE INVENTION

Using boring machines for drilling horizontal bore holes under a roadway or other obstruction is a well known practice. The process of providing such horizontal bore holes is often generally referred to as "trenchless" digging, since an open trench is not required. When high pressure sprays are used in connection with such boring mechanism to control the direction of drilling, it is often called "directional boring". A boring string comprises connected links of pipe that drive the boring drill bit blade while providing fluid under pressure to the blade for cooling or steering, or both. One example of a directional boring system is available from bor-mor, Inc., Lino Lakes, Minn. This system is described in detail in U.S. Pat. No. 5,226,488 to Lessard, et al., entitled "Truck Mounted Boring System", which is assigned to the same assignee as the present invention, the teachings of which are incorporated herein by reference.

Some other examples of horizontal boring mechanisms including known boring drill bit blade designs are disclosed in U.S. Pat. No. 5,148,880 issued Sep. 22, 1993 to Lee, et al. In that invention, a boring drill bit blade assembly is disclosed as being affixed to the front of a tapered portion of a tool body. Fluid is injected from the tool body through a nozzle and impinges on the outer surface of the boring drill bit blade to aid in the drilling action by cooling and lubricating the boring drill bit blade.

Boring drill bit blades currently used with directional boring machines for drilling horizontal bore holes have an extremely limited life span due at least in part to overheating during boring. Known boring drill bit blade designs, as disclosed in the Lee, et al. patent, teach that a stream of fluid is directed from a tool body to an exterior surface of the boring drill bit blade. Such a design positions the high pressure spray nozzle a significant distance behind the cutting edge of the boring drill bit blade. It is believed that the more distance that exists between the cutting edge and the nozzle, the less effective the jet stream of fluid will be in steering a boring string.

One motive of this invention is to provide a means to quickly and efficiently cool and steer bore hole boring drill bit blades through the means of internal fluid conduit and spray mechanisms.

SUMMARY OF THE INVENTION

The present invention provides a directional boring drill bit blade for mounting onto a boring tool. The boring tool provides fluid to the directional boring drill bit blade. The blade includes an earth boring directional boring drill bit blade body and at least one fluid conduit through said earth boring directional drill bit blade body.

In contrast to the prior art, the present invention provides high pressure fluid spray at the cutting edge of a directional earth boring drill bit blade. The apparatus of the invention thereby provides improved steering or control of the directional boring drill bit blades by ejecting fluid under pressure through internal ports or through nozzles embedded in the boring drill bit blade.

Further, since the fluid conduits of the present invention are located within the boring drill bit blade itself, the internal fluid conduits provide more effective cooling of the boring drill bit blade during use. It is believed that this will result in a longer lasting boring drill bit blade.

Further, in contrast to the prior art, the present invention provides an improved directional earth boring drill bit blade. The directional earth boring drill bit blade includes a boring drill bit blade body having at least one fluid conduit through said boring drill bit blade body. A fluid nozzle is affixed to said at least one fluid conduit. The boring drill bit blade body is adapted to be mounted to a boring tool body.

In one aspect of the invention, the directional earth boring drill bit blade comprises a plurality of conduits, each affixed to one of a plurality of nozzles located at a forward end of said boring drill bit blade body so as to direct fluid flow forward of a direction of boring.

In another example of the invention, the directional earth boring drill bit blade of the invention may further comprise a substantially flat cutting edge located at a forward end of said boring drill bit blade body.

In another example of the invention, the directional earth boring drill bit blade of the invention may further comprise a substantially rounded cutting edge located at a forward end of said boring drill bit blade body.

In yet another example a boring drill bit blade built in accordance with the present invention, the boring drill bit blade body may further comprise an inlet port in fluid communication with said plurality of conduits.

Other objects, features and advantages of the present invention will become apparent to those skilled in the art through the description of the preferred embodiment, claims and drawings herein wherein like numerals refer to like elements.

BRIEF DESCRIPTION OF THE DRAWINGS

To illustrate this invention, a preferred embodiment will be described herein with reference to the accompanying drawings.

DETAILED DESCRIPTION OF THE PREFERRED EMBODIMENT

The examples described herein with reference to the figures are intended to be by way of illustration and not limitation. For example, while the examples illustrated show a plurality of fluid outlets and fluid conduits, it will be understood by those skilled in the art having the benefit of this disclosure that, in some cases, only one fluid outlet port may be used. Further, the use of nozzles or spray jets is optional and there may be applications where it is desirable to fabricate a blade of the present invention without a nozzle or jet at the outlet port. Such a design may be useful when injecting highly viscous or abrasive fluids, for example. In some embodiments, the number of nozzles used and their placement may be varied depending upon the application for which the boring drill bit blade is intended to be used.

Figure 1:
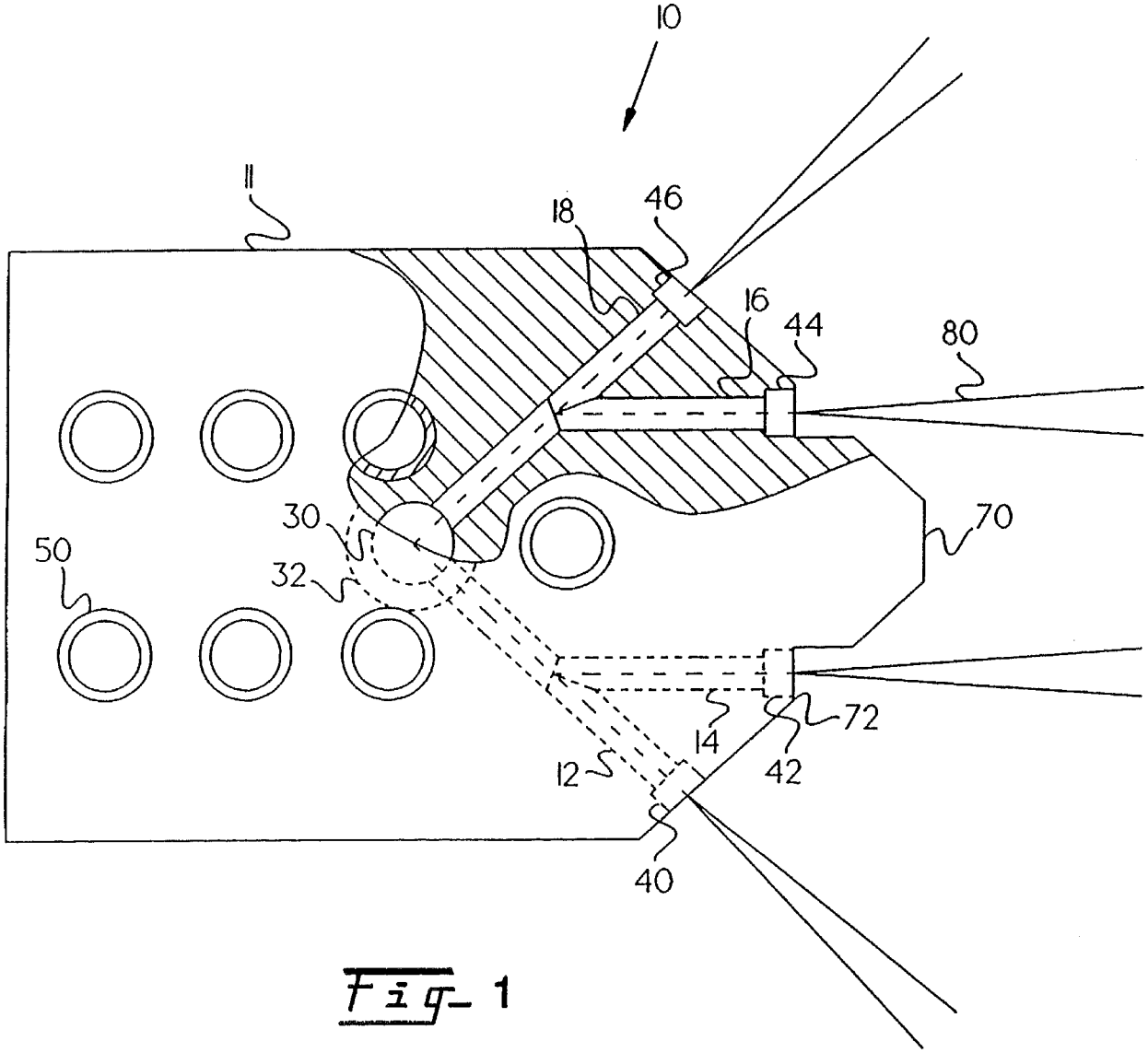
FIG. 1 shows a top view of one embodiment of an improved directional boring drill bit blade made in accordance with the present invention.

Referring now to FIG. 1, one example of a directional boring drill bit blade made in accordance with the present invention is shown. A directional boring drill bit blade 10, includes a plurality of conduits 12, 14, 16 and 18 within a boring drill bit blade body 11. Each of the conduits are in fluid communication with the others and with a fluid input port 30. A sealing means 32, as for example an O-ring, is seated within a recess 34 surrounding the inlet port 30. Each of the plurality of fluid conduits 12, 14, 16 and 18 may advantageously terminate in a nozzle or jet. A plurality of such nozzles, 40, 42, 44 and 46 may be inserted into the front of the boring drill bit blade body 11 using well known fastening means.

In one example embodiment of the directional boring drill bit blade of the invention, the nozzles 40, 42, 44 and 46 may preferably be advantageously comprised of sapphire nozzles of the type which are commercially available and known in the art or equivalent devices. Of course, other nozzle types may be substituted depending upon the particular application. A plurality of mounting holes 50, may be advantageously drilled through the boring drill bit blade 10. The mounting holes may be machined to accept standard bolts, dowels or other fasteners.

Figure 2:
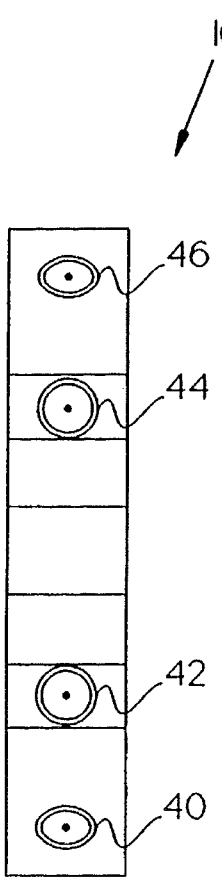
FIG. 2 shows a front view of the directional boring drill bit blade shown in FIG. 1.

Referring now to FIG. 2, which shows a front view of a directional boring drill bit blade of the invention, while continuing to refer to FIG. 1, there shown are the plurality of nozzles 40, 42, 44 and 46. The boring drill bit blade 10 may include a tip 70 optionally having a substantially trapezoidal configuration. In this example, the tip 70 is juxtaposed between nozzles 42 and 44 which are located substantially along a plane defined by surface 72 which is offset behind and adjacent to the tip 70. Nozzles 42 and 44 are positioned to direct a stream of fluid along a forward direction. Nozzles 46 and 40 are generally disposed at an acute angle with reference to nozzles 42, 44 in mirror image fashion. In this way, since the blade rotates while boring, jets of water 80 may be directed to substantially circumscribe a path along the direction of boring of the boring drill bit blade. Generally the direction of boring may be along a substantially horizontal line in a forward direction, that is, from left to right when viewing FIG. 1.

Note that the shape of the tip 70 may have various configurations depending upon particular boring applications. Other examples of blade configurations are discussed hereinbelow.

Figure 3:
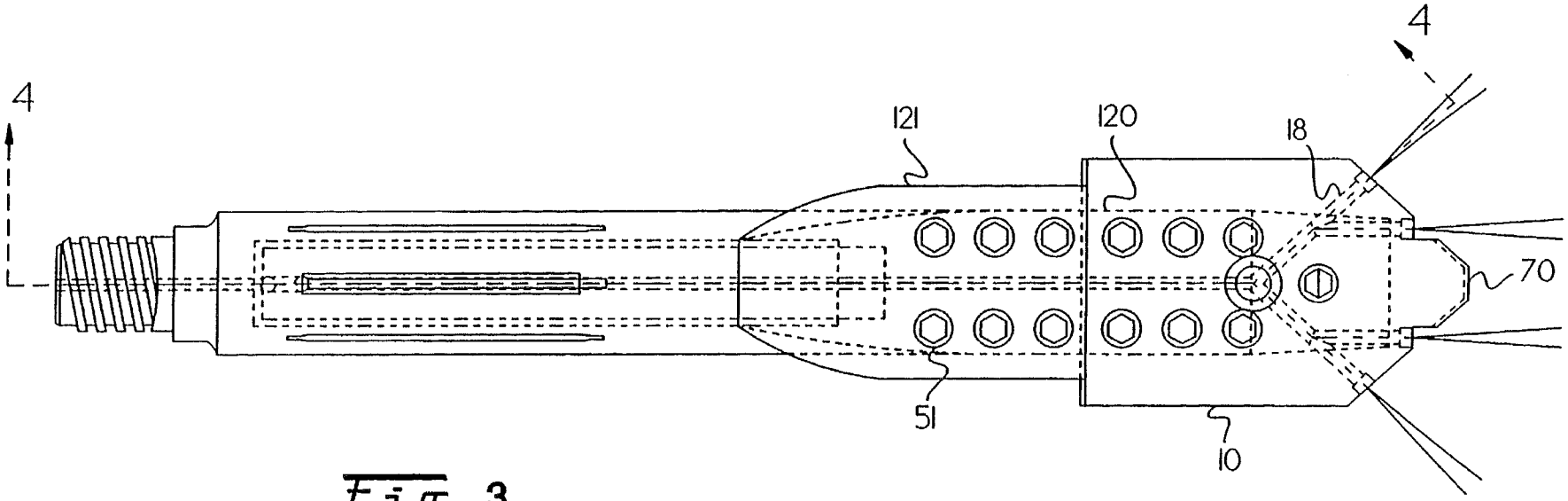
FIG. 3 shows a top view of a boring tool body employing the directional boring drill bit blade made in accordance with the present invention.

Now referring to FIG. 3, a top view of a boring tool body employing a directional boring drill bit blade of the invention is shown schematically. A mounting surface 120 comprises a substantially flat, angled surface having mounting holes 51 which are positioned to register with the corresponding mounting holes 50 on the directional boring drill bit blade 10 so that the boring drill bit blade may be fastened using bolts, dowels or equivalent fastening elements. In particular embodiments, the directional boring drill bit blade 10 may also include an extended rearward portion 121 which may be a separate piece or may be fabricated integrally with the directional boring drill bit blade.

An outlet port 100 is in fluid communication with the fluid conduit 94 and is located to register over the inlet port 30 of the directional boring drill bit blade 10. In this way, fluid enters inlet 95, flows through conduit 94 into the boring drill bit blade 10 and out of the nozzles located in the forward portion of the boring drill bit blade 10.

Figure 4:
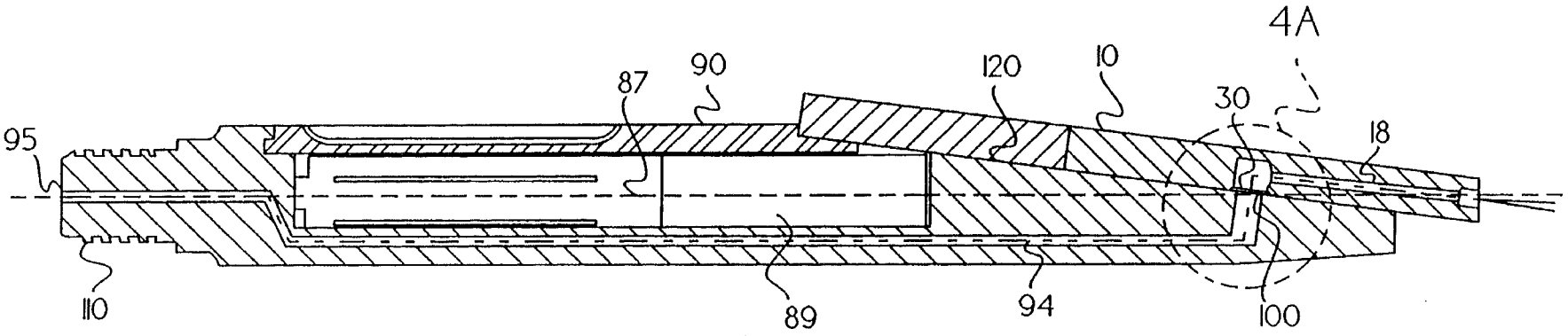
FIG. 4 shows a cross sectional view of a directional boring drill bit blade mounted to the boring tool body illustrated in FIG. 3.

Now referring to FIG. 4, a cross section of a boring tool body of the type employed by the present invention is shown. A boring tool body 90 comprises a fluid conduit 94 including an inlet 95. The fluid tool body 90 may also comprise a threaded rearward portion 110 which is suitably sized to accept a standard drill pipe stem. The directional boring drill bit blade 10 attaches by conventional fastening means to surface 120 of the tool body. As with conventional boring drill bit blades, surface 120 may preferably be angled so that the directional boring drill bit blade 10 forms an acute angle relative to a central axis 87 of the tool body 90.

The boring tool body 90 may also typically include a cavity 89 for housing a locating transmitter of the type well known in the art. Such transmitters are used to determine the orientation of the drill body while it is under ground without having to remove the boring tool body.

In operation, the tool body 90 rotates generally about an axis 87 passing through its center as generally indicated by arrow 85 while it is driven forward. Fluid 80 is introduced into the inlet 95 through the fluid conduit 94 and into the directional boring drill bit blade 10 where it is sprayed out of the plurality of nozzles forward of the boring tool body 90.

Figure 4A:
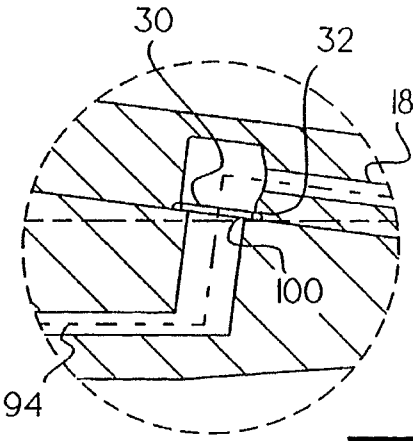
FIG. 4A shows an expanded view of a portion of the boring tool body of FIG. 4.

Referring now to FIG. 4A, an expanded view of a cross section of a portion of the boring tool body of FIG. 4 is shown illustrating the relationship between the conduit 18, the inlet port 30 and the tool body outlet port 100. Also shown is a sealing element 32 which may comprise, for example, an O-ring made substantially of rubber or equivalent sealing material. In operation, fluid is injected into inlet port 30 from outlet port 100 and then flows through the nozzles at the front of the boring drill bit blade 10.

The boring drill bit blade 10 may be fabricated from materials substantially comprising steel, carbide, ceramics or any other suitably hard endurable material or combinations of materials suitable for earth boring. The selection of material is dependent upon the type of ground encountered during boring which may include, for example, sand, clay, rock, gravel and other types of ground compositions.

Figure 5:
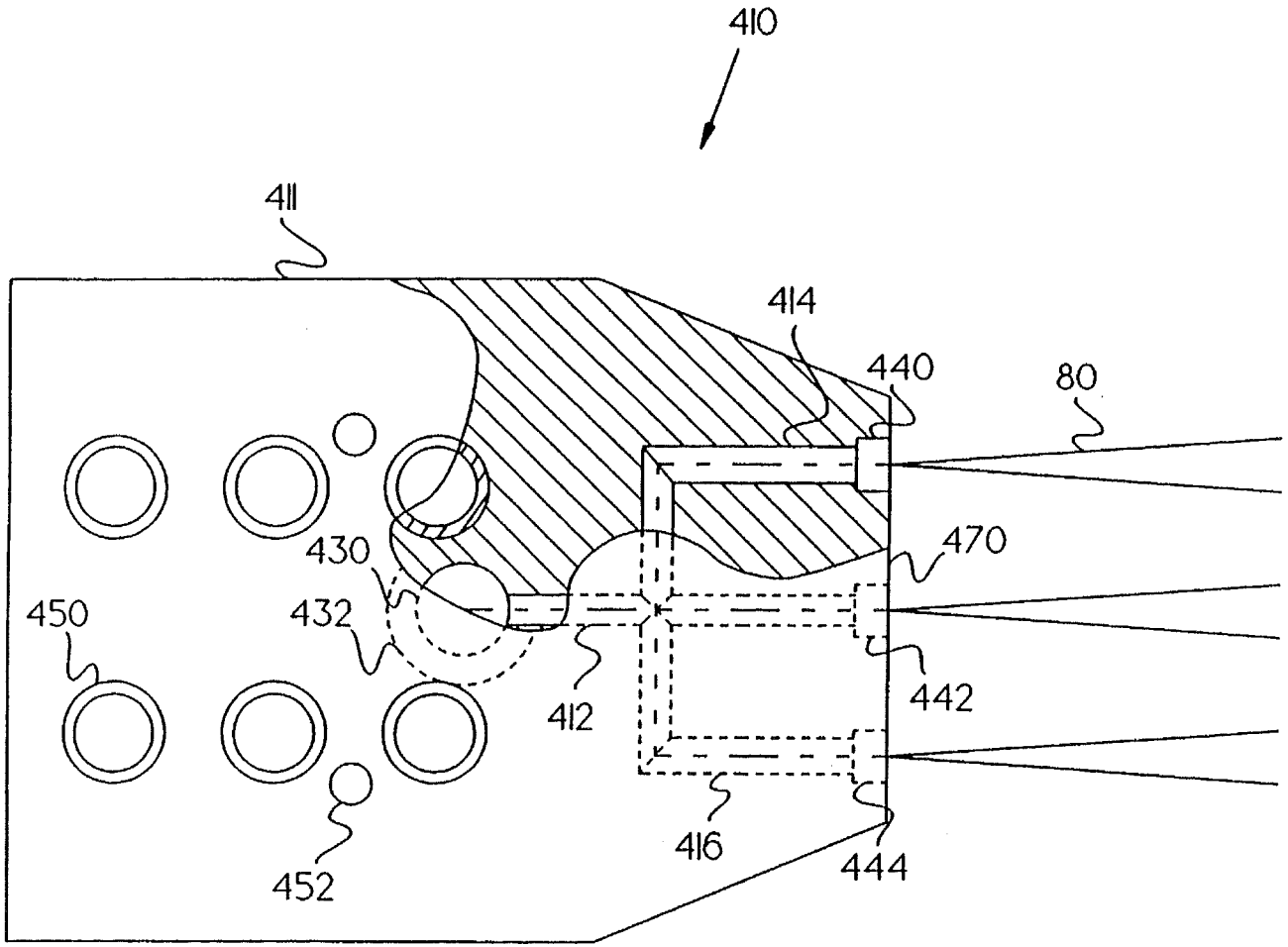
FIG. 5 shows a top view of an alternative embodiment of a directional boring drill bit blade made in accordance with the present invention having a substantially flat, planar cutting edge.

Now referring to FIG. 5, an alternative embodiment of an improved directional boring drill bit blade made in accordance with the present invention is shown. A boring drill bit blade 410 comprises a central conduit 412 within a boring drill bit blade body 411. The central conduit 412 may advantageously be in fluid communication with a plurality of outlet conduits 414 and 416. The central conduit 412 and each of the outlet conduits 414 and 416 are in communication with nozzles 440,442 and 444, respectively which are affixed into the front of the directional boring drill bit blade 410. The nozzles are positioned to direct water substantially forward of the boring drill bit blade 410. The front of boring drill bit blade 410 defines a substantially flat, planar cutting edge 470. The nozzles 440,442 and 444 may advantageously be aligned to eject fluid in a direction which is approximately perpendicular to the plane defined by the cutting edge 470. The boring drill bit blade 410 may advantageously include an O-ring 432 inserted into a recess surrounding the inlet port 430. A plurality of mounting holes 450 sized to accommodate bolts or other fasteners are provided through the boring drill bit blade 410. A plurality of dowel holes 452 may also advantageously be provided if dowels are used for fastening the blade to a tool body.

Figure 6:
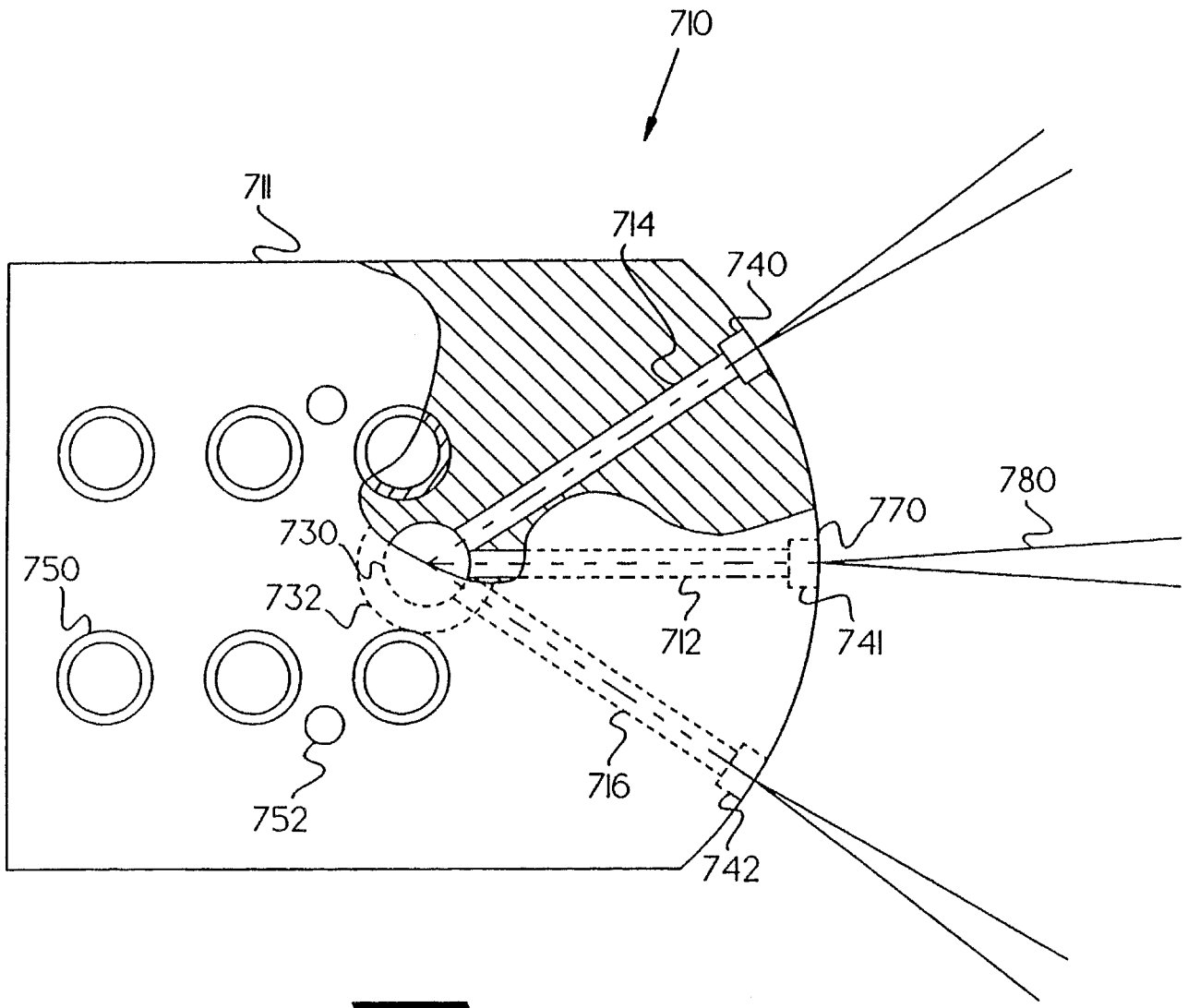
FIG. 6 shows a top view of an yet another alternative embodiment of a directional boring drill bit blade made in accordance with the present invention having a rounded cutting edge.

Now referring to FIG. 6, another alternative embodiment of an improved directional boring drill bit blade made in accordance with the present invention is shown, wherein the cutting edge has a substantially rounded shape. A boring drill bit blade 710 comprises a plurality of conduits 712,714 and 716 within a boring drill bit blade body 711. Each of the conduits 712, 714 and 716 are in communication with a nozzle 740, 741 and 742, respectively which are inserted into the front of the directional boring drill bit blade 710. The nozzles are positioned to direct water substantially forward of the boring drill bit blade 710. The boring drill bit blade 710 also includes a cutting edge 770 having a generally rounded edge. The boring drill bit blade 710 may advantageously include an O-ring 732 inserted into a recess surrounding the inlet port 730. A plurality of mounting holes 750 sized to accommodate bolts or other fasteners are provided through the boring drill bit blade 710. A plurality of dowel holes 752 may also advantageously be provided if dowels are used for fastening the blade to a tool body.

In operation, control of the fluid flow through the nozzles may be advantageously used to steer the boring tool body under ground. In this way, obstacles such as rocks or pipes may be avoided. The flow of fluid, typically water, through the boring drill bit blade 10 also operates to cool the boring drill bit blade 10. It is believed that this cooling action will increase the useful life of a directional boring drill bit blade made in accordance with the present invention. It has been found that fluid pressures of, for example, 100 psi to 5000 psi may be used to control steering depending upon ground conditions. In one mode of operation, the directional boring drill bit blade of the invention performed well using fluid under hydraulic pressure of 1200 psi.

The invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A directional boring drill bit blade for mounting onto a boring tool wherein the boring tool provides fluid, wherein the directional boring drill bit blade comprises:

(a) a directional earth boring drill bit blade body including a forward blade end having a substantially rectangular cross section and having a cutting edge; and (b) at least one fluid conduit through said directional earth boring drill bit blade body, said at least one fluid conduit having one end at the cutting edge and providing fluid for steering the boring tool.

2. The directional boring drill bit blade of claim 1 further comprising a fluid nozzle affixed to said at least one fluid conduit at the cutting edge, wherein fluid passes from the boring tool to the fluid nozzle.

3. The directional boring drill bit blade of claim 1 wherein the at least one fluid conduit comprises a plurality of conduits, each affixed to one of a plurality of nozzles located at the cutting edge of said directional earth boring drill bit blade body.

4. The directional boring drill bit blade of claim 1 wherein said directional earth boring drill bit blade body further comprises an inlet port in fluid communication with said at least one fluid conduit.

5. The directional boring drill bit blade of claim 4 wherein the inlet port comprises a recess in said directional earth boring drill bit blade body surrounding said inlet port which holds a sealing element.

6. The directional boring drill bit blade of claim 5 wherein the sealing element comprises an O-ring.

7. A tool body for use with a drill pipe stem for boring holes into the earth comprising:

(a) a tool body including, (i) a rearward end attachable to a drill pipe stem having a longitudinal axis, and (ii) a forward end;

(b) an earth boring drill bit blade, including a forward blade end having a substantially rectangular cross section and having a cutting edge, the earth boring drill bit blade being fastened to the forward end of said tool body;

(c) a fluid conduit within said earth boring drill bit blade having an inlet and an outlet; and (d) at least one fluid conduit through said earth boring drill bit blade, wherein said at least one fluid conduit directs fluid flow towards a forward end of said earth boring drill bit blade and wherein fluid flowing through said at least one fluid conduit operates to steer the tool body.

8. The tool body of claim 7 further comprising a nozzle affixed to said at least one fluid conduit, the nozzle being located at a forward end of said earth boring drill bit blade so as to eject fluid at the cutting edge.

9. The tool body of claim 7 wherein the at least one fluid conduit comprises a plurality of conduits, each affixed to one of a plurality of nozzles located at the cutting edge of said earth boring drill bit blade so as to direct fluid flow substantially towards a direction of boring.

10. The tool body of claim 7 wherein said earth boring drill bit blade further comprises an inlet port in fluid communication with said plurality of conduits.

11. The tool body of claim 10 wherein the inlet port comprises a recess within said earth boring drill bit blade, the recess surrounding said inlet port to hold a sealing element.

12. The tool body of claim 11 wherein the sealing element comprises an O-ring.

13. A directional boring tool for use in a directional boring machine comprising:

(a) an earth boring drill bit blade body having a forward end having a substantially rectangular cross section and including a cutting edge;

(b) at least one fluid conduit through said earth boring drill bit blade body, said at least one fluid conduit having one end at the cutting edge; and (c) a fluid nozzle affixed to said at least one fluid conduit at the cutting edge, wherein said earth boring drill bit blade body is adapted to being mounted to a boring tool body and wherein fluid flowing through said at least one fluid conduit operates to steer and cool said earth boring drill bit blade body.

14. The directional boring tool of claim 13 wherein the at least one fluid conduit comprises a plurality of conduits, each affixed to one of a plurality of nozzles located at the cutting edge so as to steer the directional boring machine.

15. The directional boring tool of claim 13 wherein the earth boring drill bit blade body further comprises an inlet port in fluid communication with said plurality of conduits.

16. The directional boring tool of claim 15 wherein said inlet port comprises a recess in said earth boring drill bit blade body surrounding said inlet port which holds a sealing element.

17. The directional boring tool of claim 16 wherein the sealing element comprises an O-ring.

* * * * *